US010131489B2

(12) United States Patent
Owczarek et al.

(10) Patent No.: US 10,131,489 B2
(45) Date of Patent: Nov. 20, 2018

(54) CARRIER FOR A CONTAINER FOR ROD-LIKE ARTICLES OF THE TOBACCO INDUSTRY

(71) Applicant: International Tobacco Machinery Poland Sp. z o.o., Radom (PL)

(72) Inventors: Radoslaw Owczarek, Radom (PL); Marek Warchol, Pionki (PL)

(73) Assignee: International Tobacco Machinery Poland Sp. z o.o., Radom (PL)

( * ) Notice: Subject to any disclaimer, the term of this patent is extended or adjusted under 35 U.S.C. 154(b) by 258 days.

(21) Appl. No.: 14/955,535

(22) Filed: Dec. 1, 2015

(65) Prior Publication Data

US 2016/0304271 A1 Oct. 20, 2016

(30) Foreign Application Priority Data

Nov. 26, 2014 (PL) ..... 410222

(51) Int. Cl.
*B65D 85/10* (2006.01)
*A24C 5/358* (2006.01)
*A24F 15/00* (2006.01)

(52) U.S. Cl.
CPC ..... *B65D 85/1045* (2013.01); *A24C 5/358* (2013.01); *A24F 15/00* (2013.01)

(58) Field of Classification Search
CPC .... B65D 85/1045; B65D 85/08; B65D 83/02; B65D 5/6688; B65D 5/646; B65D 5/6617; A24F 15/00
(Continued)

(56) References Cited

U.S. PATENT DOCUMENTS 3,425,581 A 2/1969 Pifer
6,027,017 A * 2/2000 Kuhn ..... B65D 5/5495 229/120.011
(Continued)

FOREIGN PATENT DOCUMENTS

DE 1882950 9/1963
EP 1941805 A1 7/2008
(Continued)

OTHER PUBLICATIONS

European Search Report, dated Mar. 4, 2016, in corresponding European application No. EP15196042.4-1656.

*Primary Examiner* — Robert Poon
(74) *Attorney, Agent, or Firm* — Browdy and Neimark, PLLC

(57) ABSTRACT

A carrier for a container for rod-like articles of the tobacco industry, the carrier interior having a cuboid-like shape, the carrier having a bottom wall, a middle sidewall and two outer sidewalls=adjoining it, while from the side of the remaining walls of the abovementioned cuboid the carrier is open. An external movable element is attached to the carrier and extending along the middle sidewall. The height of the middle sidewall is lower than the height of the outer sidewalls, so that between the outer sidewalls and the upper edge of the middle sidewall there is a void space. The movable element is movable between a first position, in which it lies opposite to the middle sidewall, and a second position, in which it lies at least partially opposite to the void space or at least partially is situated within the void space above upper edge of the middle sidewall.

10 Claims, 6 Drawing Sheets

(58) Field of Classification Search
USPC ..... 220/23.87, 243–244, 263, 810, 811; 229/164
See application file for complete search history.

(56) References Cited

U.S. PATENT DOCUMENTS

| | | | | |
|---|---|---|---|---|
| 6,478,160 | B1 * | 11/2002 | Au | A45C 11/16 206/6.1 |
| 8,322,566 | B2 * | 12/2012 | Hackett | B65D 7/16 206/1.5 |
| 8,839,741 | B2 * | 9/2014 | Cheek | A01K 1/0114 119/161 |
| 2010/0084422 | A1 * | 4/2010 | Robota | A47F 1/10 221/209 |
| 2010/0140284 | A1 * | 6/2010 | Kim | F25D 23/04 220/810 |

FOREIGN PATENT DOCUMENTS

| | | | |
|---|---|---|---|
| EP | 2596708 | A9 | 10/2013 |
| GB | 2148853 | A | 6/1985 |
| WO | 2012144914 | A1 | 10/2012 |
| WO | 2015033264 | A1 | 3/2015 |

* cited by examiner

CARRIER FOR A CONTAINER FOR ROD-LIKE ARTICLES OF THE TOBACCO INDUSTRY

FIELD

A carrier for a container for rod-like articles of the tobacco industry is disclosed.

BACKGROUND

Filter rods (also described in the present text in general as rod-like articles) made of both a single type of filtering material as well as multi-segment rods comprising segments made of various materials are necessary for manufacturing cigarettes. The rods are supplied to the manufacturers of cigarettes in cardboard containers, there are known multiple various devices for filling such containers. These containers constitute usually cuboidal boxes which have a relatively large bottom and four low sidewalls (their height being adjusted to the length of rods packaged inside them) and a removable lid. However they are not rigid and usually are not suitable for filling or emptying without the use of additional means in the form of carriers, into which the containers are inserted throughout the filling process.

In the tobacco industry various carriers are widely used, usually rigid, made of plastic, for temporary storage of rod-like articles such as cigarettes, cigarillos, filter rods or cigars. Such a conventional carrier, known inter alia from the description of German utility model application DE1882950U, may be used for temporary placement of a container made of a non-rigid material inside it.

Furthermore, a carrier adapted for emptying of a non-rigid filter rod container provided with a cross member holding the container so that the rods just before unloading are closed in a space limited by five walls is known from publication GB2148853A.

On the other hand, a circulatory carrier into which a container made of non-rigid carton-like or cardboard material is inserted, and out of which the container is removed upon being filled with rods, or rod-like articles in general, is known from publication EP2596708A9.

When a carrier of the abovementioned type is used to fill containers which are not rigid, the container from which the lid has been removed, is placed inside the carrier so that during filling thereof its bottom and two shorter side walls are positioned vertically, the container being situated so that one of the longer sidewalls is supported by the bottom of the carrier, and the other longer wall, which after being placed in the carrier constitutes its upper wall, is tilted in order to enable filling the container with rods from the top. Therefore, the space limited by the bottom and three sidewalls of the container is filled with rods. After filling the container its upper wall should be tilted back to be placed in its original position, closing the perimeter of the container.

The arrangement of filter rods in the container desired by cigarette manufacturers is a honeycomb-type arrangement, meaning maximum filling of the container space with no gaps between the rods. The cigarette manufacturers also expect the rods in the containers to be slightly compressed, since with too loose arrangement of the rods there is a risk that rods in the container may position themselves obliquely in relation to the others.

An inconvenience of the known carriers of the abovementioned type is that while using them to fill the containers, the tilting sidewall is locked in such a way that in order to tilt it back and place in its due position after filling the container and subsequently to close the container, it should be firstly unlocked, for which it is necessary to remove the container from the carrier. It is a major hindrance, since while removing the open container with one sidewall still tilted, the rods—particularly if they are slightly compressed—can easily spill out.

SUMMARY

The purpose of the invention is to obtain a carrier in which containers of the abovementioned type are placed for the duration of filling them with rod-like articles, in which the abovementioned problem would be eliminated.

According to the invention there has been developed a carrier for a container for rod-like articles of the tobacco industry, the interior of which has a cuboid-like shape, the carrier having a bottom wall, a middle sidewall having a first height and two adjoining outer sidewalls having a second height, while from the side of the remaining walls of the abovementioned cuboid the carrier is open; furthermore, an external movable element is attached to the carrier, and said movable element extending along the middle sidewall.

The carrier according to the invention is characterised in that the height of the middle sidewall is lower than the height of the outer sidewalls, so that between the outer sidewalls and the upper edge of the middle sidewall there is a void space, while the movable element is movable between the first position, in which it lies opposite to the middle sidewall, and the second position, in which it lies at least partially opposite to the void space or at least partially is situated within the void space, above upper edge of the middle sidewall.

The movable element may be attached to the carrier by means of two rotating arms, one end of each arm being fixedly connected to one end of the movable element, and its other end being connected rotationally to the respective outer sidewall.

Alternatively, the movable element may also be attached to the carrier by means of two arms movable along the outer sidewalls, one end of each arm being fixedly connected to one end of the movable element, and its other end being slidably connected to the respective outer sidewall.

Preferably, the movable element is locked in a position opposite to the void space by means of a locking mechanism.

The movable element can be locked by means of the locking mechanism selected from a group comprising a latching mechanism, a spring mechanism, a ratchet mechanism and other similar means.

Preferably, the movable element constitutes a slat or a bar.

Due to the carrier according to the invention, it is possible to narrow down the tolerance of the number of rod pieces which are placed in the container. Furthermore, the carrier enables partial closing of the container prior to removing it therefrom.

BRIEF DESCRIPTION OF THE DRAWINGS

The object of the invention will be presented in more detail in preferable embodiments in the drawing, in which.

DETAILED DESCRIPTION

The following terms used in reference to all figures: bottom wall, sidewall, upper wall, wall height, refer—both in the case of the carrier as well as the container—to their position presented in the figures.

Figure 1:
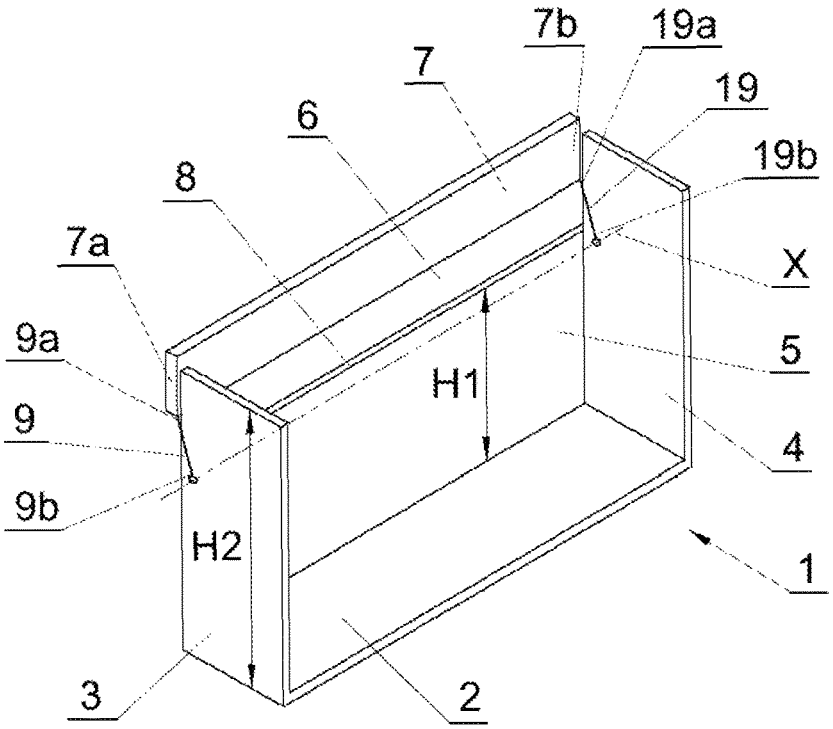
FIG. 1 shows a perspective view of the carrier according to the first embodiment.

The carrier 1 shown in FIG. 1 being the object of the present application has the shape of a cuboid and has four walls: bottom wall 2, middle sidewall 5 and two smaller, outer sidewalls 3, 4. As seen in FIG. 1, the middle sidewall 5 has the height H1 smaller than the height H2 of the outer sidewalls 3, 4, due to which there is a void space 6 between the outer sidewalls 3, 4 and the upper edge 8 of the middle sidewall 5. In the described embodiment the carrier 1 has a movable element 7 in the form of a slat. Each end 7*a* and 7*b* of the slat 7 is fixedly connected to the respective end 9*a*, 19*a* of the arm 9, 19, the opposite ends 9*b*, 19*b* of which are rotationally connected to the respective outer sidewall 3, 4. The movable element 7, which is displaced e.g. by the operator, can take at least two positions—upper, shown in FIG. 1, and lower, shown e.g. in FIG. 4, due to the rotation of the arms 9, 19 about their points of attachment on the respective sidewalls 3, 4 about the X axis. The function of the movable element 7 will be described in further text. The movable element 7 may also have the form of a bar, or any other elongated element which would be able to serve the function described below. A person skilled in the art will easily select the proper movable element. The carrier 1 as shown in FIG. 1 stands on the bottom wall 2 and is shown without the container being filled, which container is slidably inserted inside interior thereof.

Figure 2:
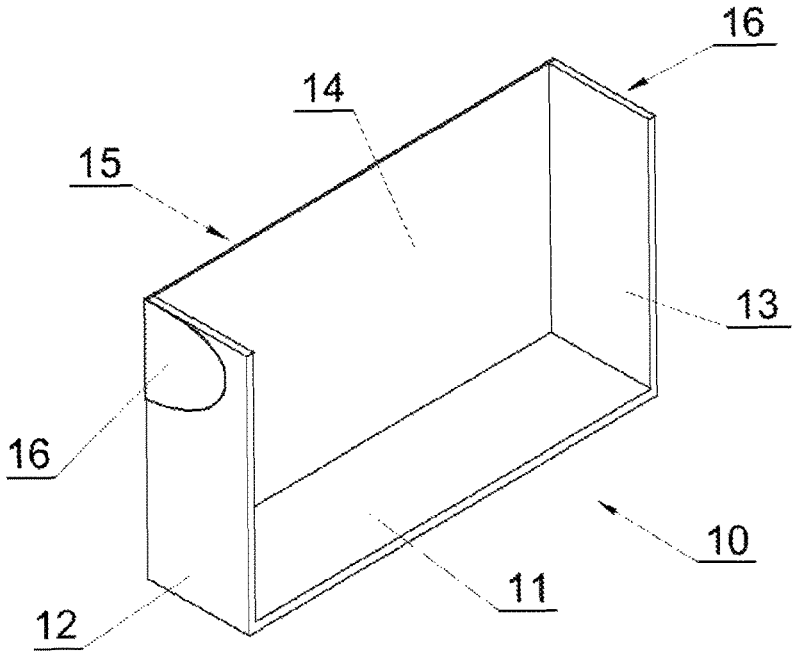
FIG. 2 shows a perspective view of the container placed in the carrier according to the invention, with one wall tilted.

FIG. 2 shows the container 10 having a cuboid-like shape, having five walls, and ready to fill with rod-like articles. The container shown in FIG. 2 has a bottom wall 11 (during transport and storage of the filled container it is one of its longer sidewalls), two outer sidewalls 12 and 13 (during transport and storage of the filled container these are its shorter sidewalls), a middle sidewall 14 (during transport and storage of the filled container it is its bottom wall), the tilted upper wall 15 (during transport and storage of the filled container it is the second of its longer sidewalls), while from the side of the remaining sidewall (which upon filling the container is closed with a lid) the container is open. As seen in FIG. 2, the upper wall 15 of the container 10 is tilted and adheres the wall 14 from the outside (the untilted wall 15 is visible in FIG. 6). The wall 15 has flaps 16, which in this position overlap from the outside with walls 12 and 13.

Figure 3:
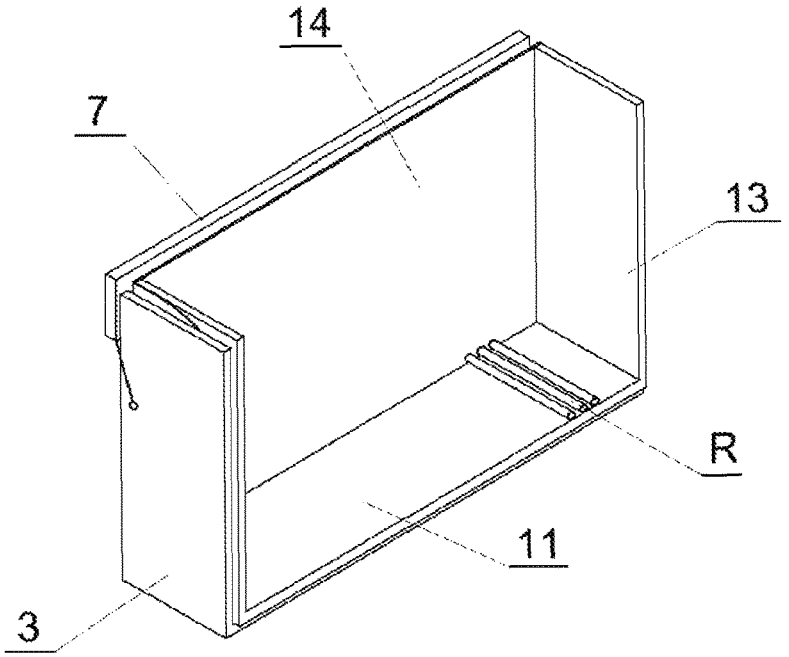
FIG. 3 shows a perspective view of the container from FIG. 2, ready for being filled and placed in the carrier according to the invention.

FIG. 3 shows the carrier 1 with the container 10 of FIG. 2 inserted inside it, ready for filling. FIG. 3 shows only several rod-like articles, e.g. the rods R, with which the container is filled in multiple layers over the whole height of the container 10. Upon inserting the container 10 into the carrier 1 the outer sidewalls 12 and 13 of the container 10 adhere respectively to the outer sidewalls 3 and 4 of the carrier 1, while the bottom wall 11 adheres to the bottom wall 2 of the carrier 1, and the middle wall 14 to the wall 5 of the carrier 1. Usually, the upper wall and sidewall remain open during the filling of the container. Most loading devices for carriers and containers fill the carriers and containers from the top, but there are also loaders adapted to filling the containers via an open sidewall. The movable element 7 is placed in the upper position, and its function is to press against the tilted upper wall 15 of the container 10, which in this position fills the void space 6. The movable element 7 in the upper position completes the lower middle wall 5 of the carrier 1 and constitutes a support for the sidewall 14 along with the tilted wall 15.

Figure 4:
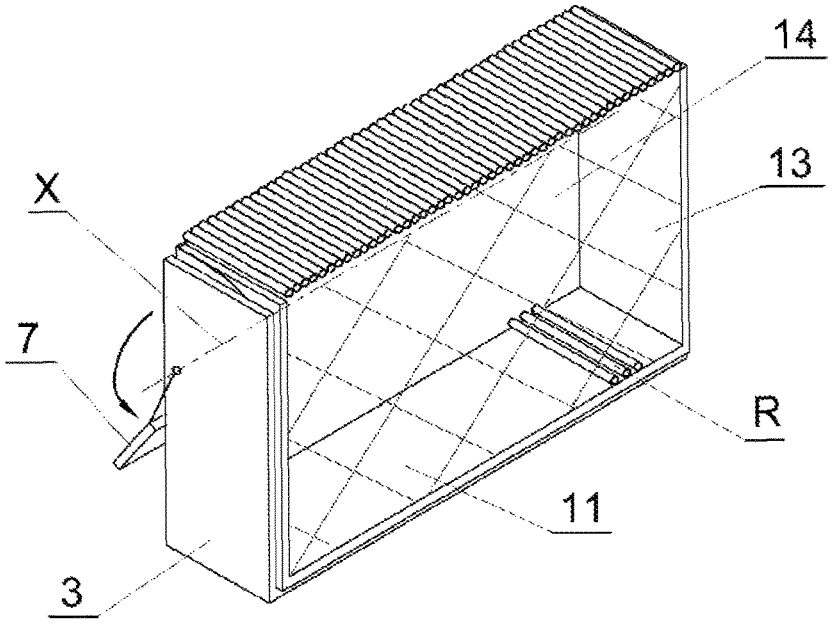
FIG. 4 shows a perspective view of the filled container placed in the carrier according to the invention, which movable element has been lowered upon filling the container.

FIG. 4 shows the carrier 1, in which the container is placed upon filling, with only several rods R being shown lying in the lowermost layer on the bottom wall of the container, along with the uppermost layer of rod-like articles, which is located above the upper edges of sidewalls 12, 13 and 14. The remaining area of the container filled with rods R has been indicated by intersecting skewed lines. At this stage the movable element 7 is tilted, by rotation indicated by the arrow about the axis X, from the upper holding position shown in FIG. 3 to the lower position.

Figure 5:
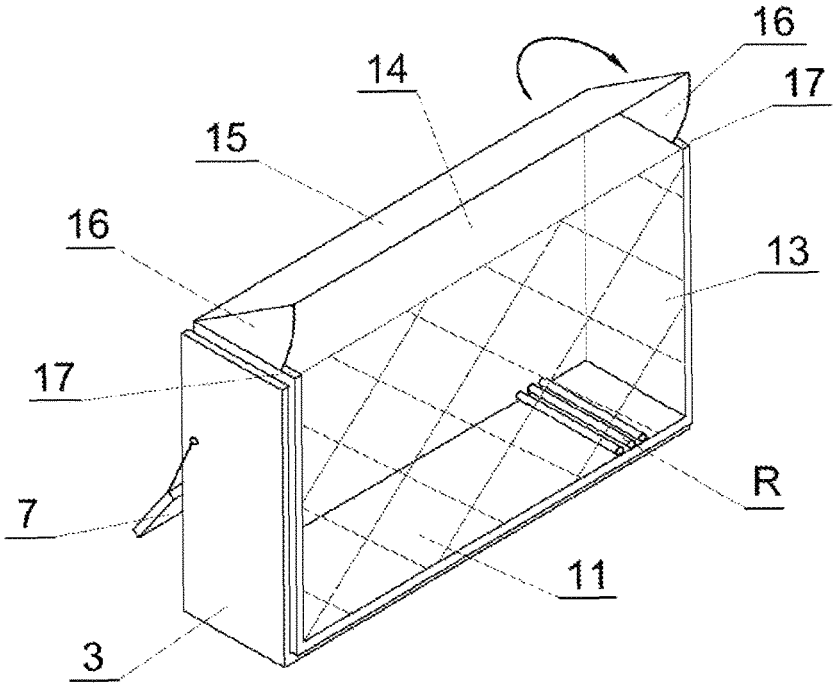
FIG. 5 shows a perspective view of the container still placed in the carrier according to the invention during closing of its tilted wall.

In FIG. 5 it is visible that the upper wall 15 of the container 10 is subsequently rotated as indicated by the arrow, the flaps 16 extending sideways from the wall 15 being slipped from the top into slits 17 in the outer sidewalls 12, 13. Due to the fact that the movable element has been tilted downwards, the wall 15 of the container may be freely tilted back to its due position, to close the perimeter of the container. Similar as in FIG. 4, the area of the container filled with rods R has been indicated with intersecting skewed lines, but for simplicity the topmost layer of rods R has not been shown, which layer during rotation of the wall 15 is pressed against the lower situated rods R causing slight compression of all rods R in the container. Due to the fact that the perimeter of the container comprising the compressed rods R is closed when the container is still inside the carrier, there is no risk that the rods will spill out.

Figure 6:
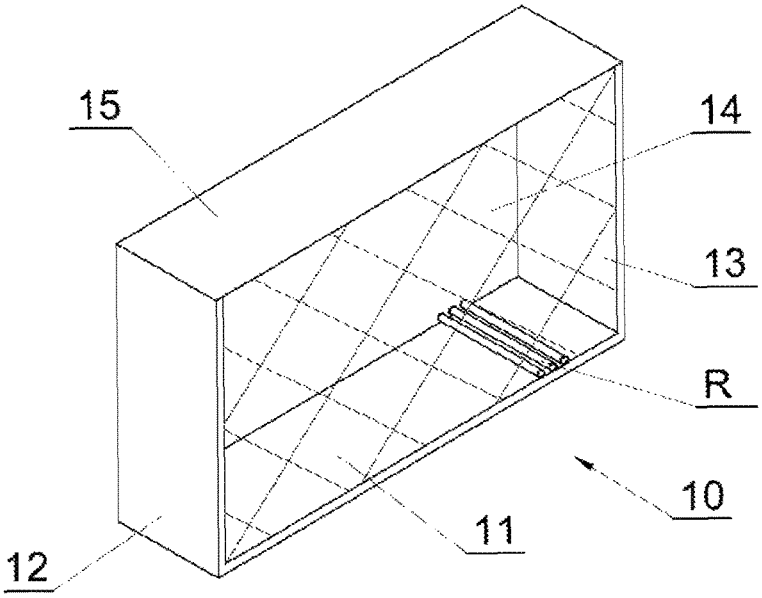
FIG. 6 shows a perspective view of the container with the previously tilted wall thereof placed in due position.

FIG. 6 presents the container 10 in the form which it takes after being filled with rods R and after complete closing of the upper wall 15. For the duration of transport the container 10 is put on the wall 14 and covered with the lid. Like in FIG. 3-5, the rods R are shown only symbolically; in reality they tightly fill the whole container.

Figure 7:
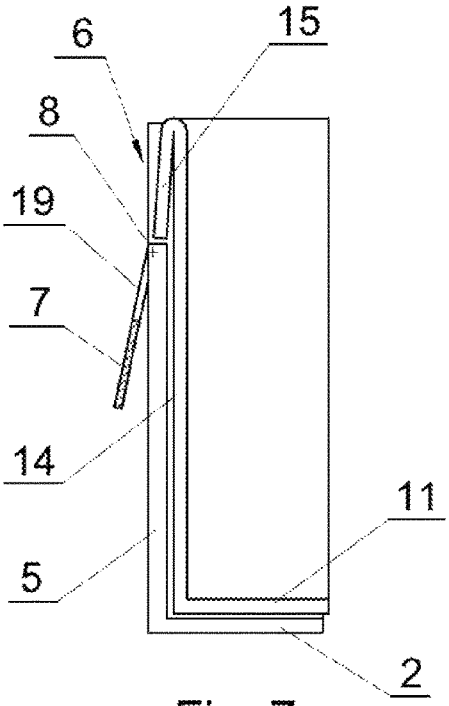
FIG. 7 shows a vertical section of the carrier from FIG. 1 with the container placed inside it and with the movable element lowered.
Figure 8:
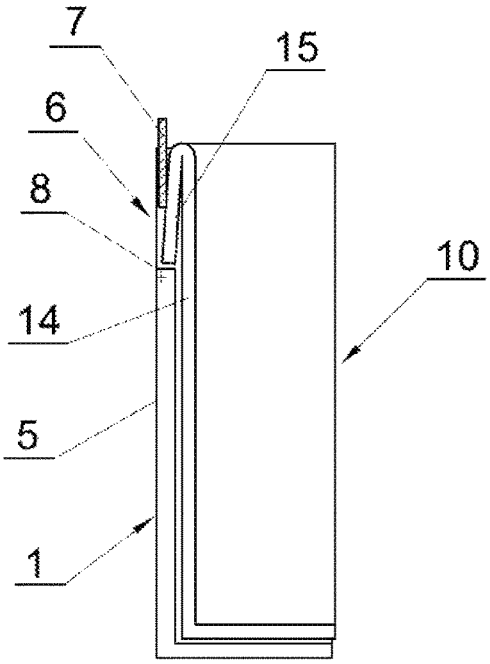
FIG. 8 shows a vertical section of the carrier from FIG. 7 with the container placed inside it and the movable element raised.
Figure 9:
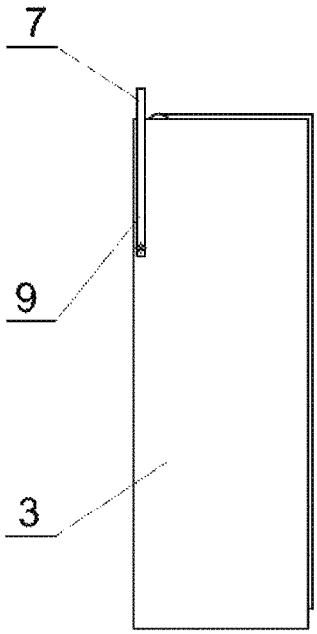
FIG. 9 shows a side view of the carrier from FIGS. 7 and 8 with the movable element raised.

The movable element 7 according to the first embodiment, shown in FIGS. 7, 8 and 9, has the form of a flat slat attached fixedly to the two rotating arms 9, 19. The movable element 7 in the first position opposite to the wall 5 is shown in FIG. 7, and in the second upper position—in FIG. 8. The movable element 7 is located within the void space 6, such position being possible in which the movable element partially protrudes outside the carrier 1, and partially is situated within the void space 6. The movable element 7 may partially protrude over the upper edges of sidewalls 3, 4.

Figure 10:
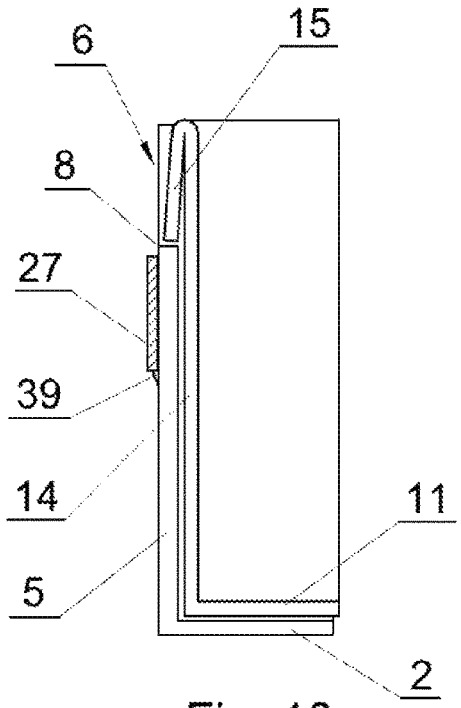
FIG. 10 shows a vertical section of the carrier according to the second embodiment of the invention with the container placed inside it and with the movable element lowered.
Figure 11:
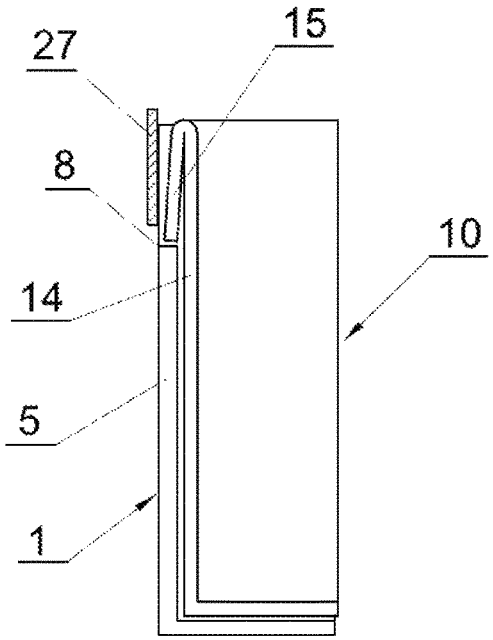
FIG. 11 shows a vertical section of the carrier from FIG. 10 with the container placed inside it and with the movable element raised.
Figure 12:
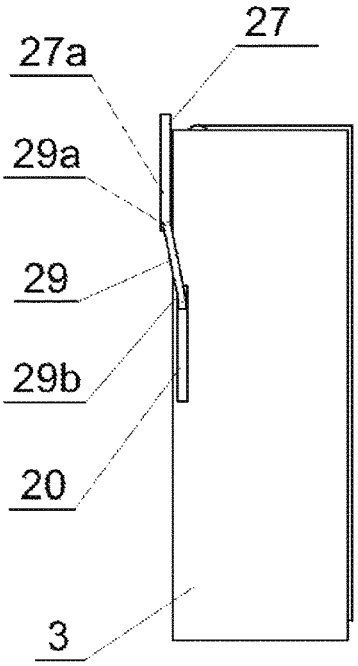
FIG. 12 shows a side view of the carrier from FIGS. 10 and 11 with the movable element raised.

The movable element 27 according to the second embodiment, as shown in FIGS. 10, 11 and 12, also has the form of a slat fixedly attached to the arms 29, 39, the arms 29, 39 being slidably attached to walls 3, 4 of the carrier 1. The arm 29 visible in FIG. 12 is fixedly connected via its end 29*a* with the end 27*a* of the movable element 27, while an end 29*b* of the arm 29 is slidably connected to wall 3, for example by means of a guide 20. Correspondingly, the opposite arm 39 (seen partially in FIG. 10) is fixedly connected via an end 39*a* to the end 27*b* of the movable element 27, while an end 39*b* of the arm 39 is slidably connected to wall 4. FIG. 10 presents the movable element 27 in the first position opposite to the wall 5, and FIGS. 11 and 12—in the second position.

Figure 13:
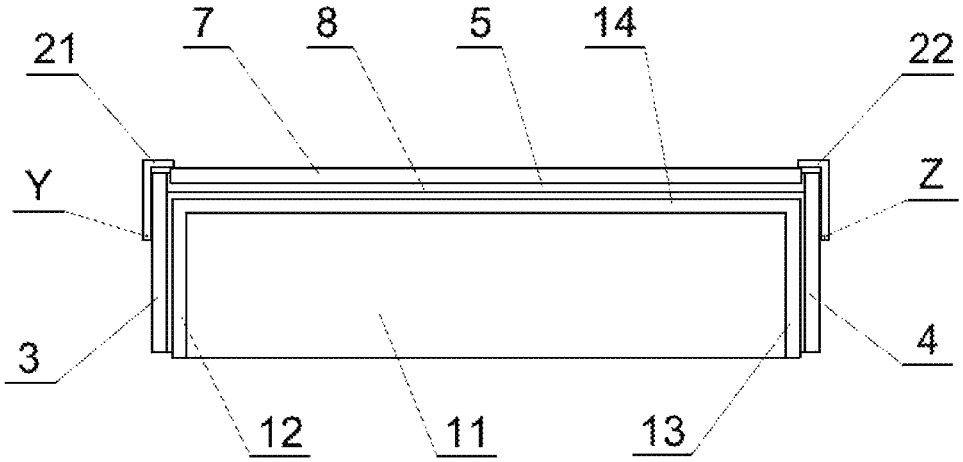
FIG. 13 shows a top view of the carrier with the container and the movable element locked.

FIG. 13 shows the carrier 1 along with the container 10 placed inside, and the movable element 7, which is supported by fasteners 21 and 22, the movable element 7 being shown in its second, upper position. For simplicity, the arms to which the movable element 7 is attached have not been shown. Fasteners 21 and 22 may rotate about the Y and Z axes respectively (generally perpendicular to the bottom wall 11) and may take at least two positions, first—the position of holding the movable element 7 as shown in FIG. 13, and the second position, for example upon rotation outside the carrier, in which the movable element 7 may be tilted or slipped. Various typical latching, ratchet or spring mechanisms may be also used for holding the movable element.

The invention claimed is:

1. A carrier for a container for rod-like articles of the tobacco industry, the carrier having an interior, the interior of the carrier having a cuboid-like shape, said carrier comprising:

a bottom wall, a middle sidewall having a first height, two outer sidewalls adjoining the middle sidewall and having a second height, the carrier being open at a side opposite to the middle sidewall between the two outer sidewalls, an external movable element attached to the carrier and extending along the middle sidewall, and two rotating arms attached to the external movable element and the carrier, each arm having a first end being fixedly connected to one end of the external movable element, and a second end being rotationally connected to one of the outer sidewalls, the two rotating arms having a length between the first end and the second end extending parallel to the two outer sidewalls, wherein the first height of the middle sidewall is lower than the second height of the outer sidewalls, such that a void space is defined between the outer sidewalls and an upper edge of the middle sidewall, and wherein the external movable element is movable between a first position, in which the external movable element lies opposite to the middle sidewall, and a second position, in which the external movable element lies at least partially opposite to the void space or at least partially is situated within the void space above the upper edge of the middle sidewall.

2. A carrier for a container for rod-like articles of the tobacco industry, the carrier having an interior, the interior of the carrier having a cuboid-like shape, said carrier comprising:

a bottom wall, a middle sidewall having a first height, two outer sidewalls adjoining the middle sidewall and having a second height, the carrier being open at a side opposite to the middle sidewall between the two outer sidewalls, an external movable element attached to the carrier and extending along the middle sidewall, and two arms connected to the external movable element and to the carrier and slidable along the outer sidewalls, each arm having a first end fixedly connected to one end of the external movable element, and a second end slidably connected to one of the outer sidewalls, the two rotating arms having a length between the first end and the second end extending parallel to the two outer sidewalls, wherein the first height of the middle sidewall is lower than the second height of the outer sidewalls, such that a void space is defined between the outer sidewalls and an upper edge of the middle sidewall, and wherein the external movable element is movable between a first position, in which the external movable element lies opposite to the middle sidewall, and a second position, in which the external movable element lies at least partially opposite to the void space or at least partially is situated within the void space above the upper edge of the middle sidewall.

3. The carrier according to claim 1, further comprising a locking mechanism to lock the external movable element in a position opposite to the void space.

4. The carrier according to claim 3, wherein the locking mechanism is selected from a group comprising a latching mechanism, a spring mechanism, and a ratchet mechanism.

5. The carrier according to claim 1, wherein the external movable element comprises a slat or a bar.

6. The carrier according to claim 1, wherein the two arms are connected to the carrier on an outer surface of the two outer side walls.

7. The carrier according to claim 2, further comprising a locking mechanism to lock the external movable element in a position opposite to the void space.

8. The carrier according to claim 7, wherein the locking mechanism is selected from a group comprising a latching mechanism, a spring mechanism, and a ratchet mechanism.

9. The carrier according to claim 2, wherein the external movable element comprises a slat or a bar.

10. The carrier according to claim 2, wherein the two arms are connected to the carrier on an outer surface of the two outer side walls.

* * * * *